US006193288B1

(12) United States Patent
Taga et al.

(10) Patent No.: US 6,193,288 B1
(45) Date of Patent: Feb. 27, 2001

(54) ELECTRIC LID CLOSURE

(75) Inventors: Shigenori Taga; Jun Yamagishi, both of Yokohama (JP)

(73) Assignee: Ohi Seisakusho Co., Ltd., Yokohama (JP)

( * ) Notice: Subject to any disclaimer, the term of this patent is extended or adjusted under 35 U.S.C. 154(b) by 0 days.

(21) Appl. No.: 09/358,646

(22) Filed: Jul. 23, 1999

(30) Foreign Application Priority Data

Jul. 23, 1998 (JP) ..... 10-208301
Jul. 23, 1998 (JP) ..... 10-208302

(51) Int. Cl.[7] ..... E05B 15/02
(52) U.S. Cl. ..... 292/341.16; 292/DIG. 43; 292/340; 49/280
(58) Field of Search ..... 292/340, 201, 292/216, 341.16, DIG. 23, DIG. 43; 70/277, 279; 49/280

(56) References Cited

U.S. PATENT DOCUMENTS

Re. 33,758 * 12/1991 Compeau ..... 292/216
4,237,709 * 12/1980 Krugener ..... 70/107
4,470,626 * 9/1984 Gergoe ..... 292/341.12
5,209,531 * 5/1993 Thau ..... 292/216
5,217,266 * 6/1993 Kostler ..... 292/201
5,443,292 8/1995 Shimada et al. ..... 292/341.16
5,494,324 * 2/1996 Kleefeldt ..... 292/340
5,785,364 * 7/1998 Kleefeldt ..... 292/201
5,785,365 * 7/1998 Lorey ..... 292/216

* cited by examiner

*Primary Examiner*—Gary W. Estremsky
(74) *Attorney, Agent, or Firm*—Foley & Lardner

(57) ABSTRACT

An electric lid closure generally comprises a lock unit mounted to a trunk lid and an electric closing unit mounted to a trunk room mouth. The lock unit includes a latch plate, and the electric closing unit includes a support base, a striker base pivotally connected through a pivot pin to the support base, a striker formed on the striker base and engageable with the latch plate, and an electric power mechanism for pivoting the striker base between uppermost and lowermost positions by an electric power. A leading edge of the striker is inclined relative to an imaginary plane over which the striker base turns about the pivot pin.

9 Claims, 7 Drawing Sheets

ELECTRIC LID CLOSURE

BACKGROUND OF THE INVENTION

1. Field of the Invention

The present invention relates to electric lid closures which close and open a lid by force of an electric power, and more particularly to electric lid closures of a type which is applied to a trunk lid of a motor vehicle to draw down the lid to its full close position by force of the electric power once the lid comes to a predetermined almost close position.

2. Description of the Prior Art

Hitherto, various lid closures of the above-mentioned type have been proposed and put into practical use particularly in the field of motor vehicles. Some are of a type which comprises a lock unit mounted on a trunk lid and an electric closing unit mounted on a mouth portion of a trunk room of the vehicle. The lock unit includes a latch plate and a locking plate. The electric closing unit comprises an electric motor and a movable base plate formed with a striker. When the trunk lid is pivoted down to an almost close position where the latch plate engages with the striker, the electric closing unit starts to operate and causes the movable base plate to move downward thereby to draw down the trunk lid, via the latched striker, to a full close position by force of the electric motor. Upon sensing the full close position reached by the trunk lid, the electric closing unit stops its operation. In this full close position of the trunk lid, the movable base plate assumes its lower work position and a water-tight sealing between the periphery of the trunk lid and that of the trunk room mouth by means of a weather strip disposed therebetween.

When, under this full close position of the trunk lid, a trunk open lever arranged in the vehicle cabin is manipulated by a driver or passenger, the locking plate disengages the latch plate causing the same to release the trunk lid. Upon sensing the disengagement of the latch plate from the locking plate, the electric closing unit starts to run in a reversed direction and moves up the movable base plate to its upper stand-by position. When the movable base plate reaches this upper stand-by position, operation of the electric closing unit stops.

In the electric lid closures of the above-mentioned type, an arrangement is conventionally employed wherein a first direction along which the latch plate moves toward the striker for engagement therewith is in parallel with a second direction along which the movable base plate travels from the upper stand-by position to the lower work position.

However, this parallel moving arrangement tends to cause a slanted posture of the electric closing unit on the trunk room mouth when the above-mentioned first direction is angled relative to the electric closing unit. In fact, this angled relation is needed by the weather strip for achieving an assured water-tight sealing between the trunk lid and the trunk room mouth.

However, the slanted posture of the electric closing unit inevitably causes a lower portion thereof to be largely projected into the trunk room, which reduces an effective capacity of the trunk room.

SUMMARY OF THE INVENTION

It is therefore an object of the present invention to provide an electric lid closure which is free of the above-mentioned drawback.

According to a first aspect of the present invention, there is provided an electric lid closure for use with an automotive trunk lid which pivots to close a trunk room of the vehicle. The electric lid closure comprises a lock unit adapted to be mounted to the trunk lid, the lock unit including a latch plate; and an electric closing unit adapted to be mounted to a mouth portion of the trunk room, the electric closing unit including a support base, a striker base pivotally connected through a pivot pin to the support base, a striker formed on the striker base and engageable with the latch plate, and an electric power mechanism for pivoting the striker base between uppermost and lowermost positions by an electric power, wherein a leading edge of the striker is inclined relative to an imaginary plane over which the striker base turns about the pivot pin.

According to a second aspect of the present invention, there is provided an electric lid closure for use with an automotive trunk lid which pivots to close a trunk room of the vehicle. The electric lid closure comprises a lock unit adapted to be mounted to the trunk lid, the lock unit including a latch plate and a lock base, the lock base being formed with a striker inserting guide slot; and an electric closing unit adapted to be mounted to a mouth portion of the trunk room, the electric closing unit including a support base, a striker base pivotally connected through a pivot pin to the support base, a striker bar defined by the striker base and capable of inserting into the striker inserting guide slot for engagement with the latch plate, wherein the striker bar has a generally trapezoidal cross section with a leading edge thereof made thinner than a trailing edge thereof.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, description will be made with respect to an electric lid closure "ELC" of the present invention, which is operatively applied to a trunk lid of a motor vehicle.

Figure 2:
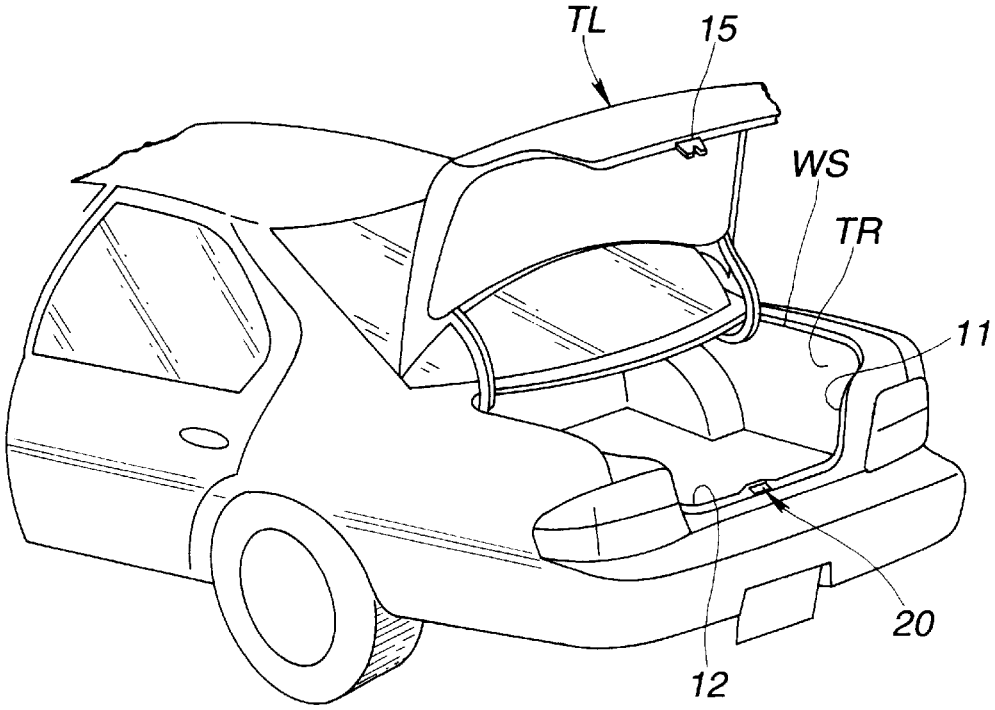
FIG. 2 is a rear view of a motor vehicle, showing the electric lid closure of the invention applied to a trunk lid of the vehicle.

Referring to FIG. 2, there is shown a rear part of the motor vehicle, which has a trunk room "TR" equipped with a trunk lid "TL". In the illustrated vehicle, the trunk lid "TL" is pivotally connected to the vehicle body to open and close the trunk room "TR".

As is seen from this drawing, the electric lid closure "ELC" generally comprises a lock unit 15 mounted on a free center end of the lid "TL" and an electric closing unit 20 mounted on a periphery 12 of a mouth portion 11 of the trunk room "TR". A weather strip "WS" is bonded to the periphery 12 of the mouth portion 11. With this weather strip "WS", a water-tight abutment of the lid "TL" to the periphery 12 of the mouth portion 11 is achieved when the lid "TL" assumes its full close position relative to the trunk room "TR".

Figure 6A:
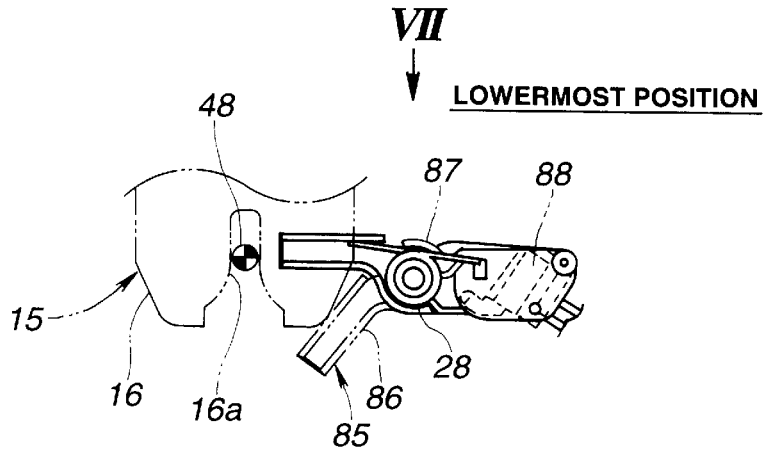
FIGS. 6A, 6B and 6C are views taken from the direction of the arrow "VI" of FIG. 3, respectively showing different conditions of the electric lid closure.

As is seen from FIGS. 2 and 6A, the lock unit 15 comprises a lock base 16 which is formed with a striker inserting guide slot 16*a*, a latch plate (not shown) which is pivotally connected to the lock base 16 to pivot between a latch position to latch a striker 45 held by the electric closing unit 20 and an unlatch position to unlatch the striker 45, and a locking plate (not shown) which is pivotally connected to the lock base 16 to pivot between a lock position to lock the latch plate at the latch position and a release position to release the latch plate to permit the same to take the unlatch position. The detail of this lock unit 15 is described in for example U.S. Pat. No. 5,443,292 granted on Aug. 22, 1995.

Figure 1:
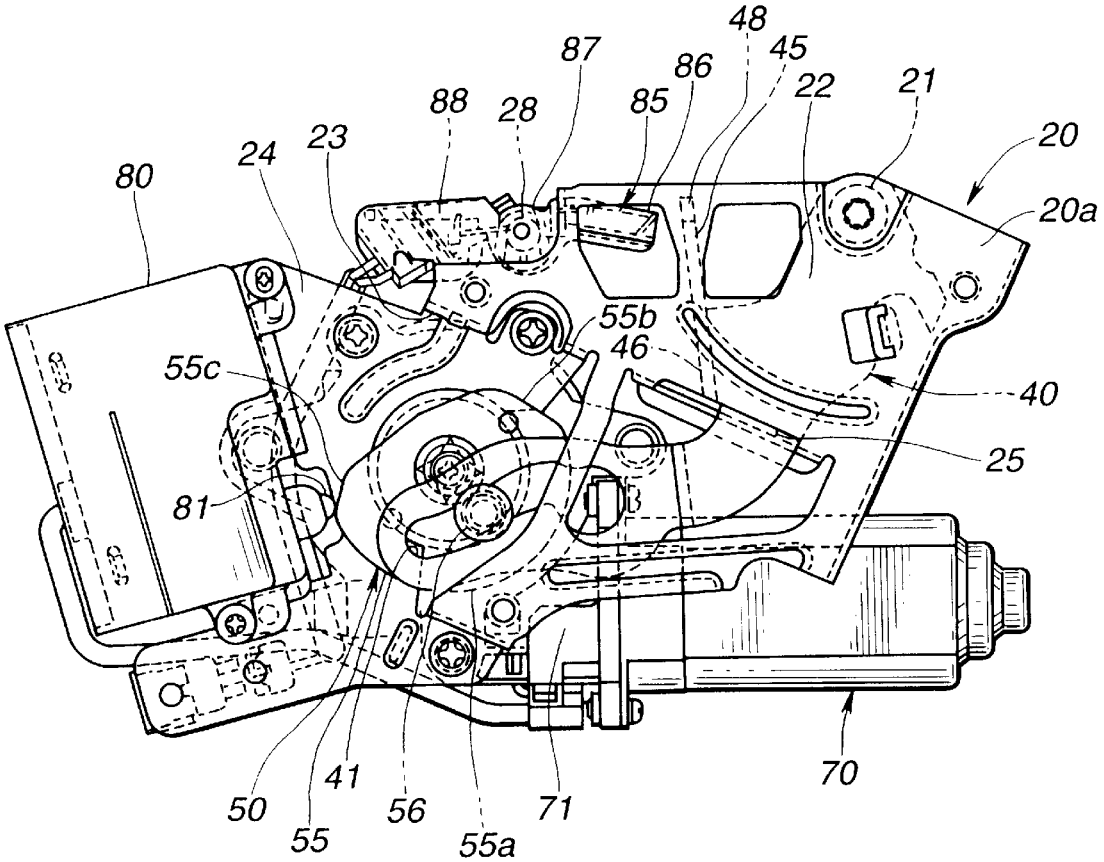
FIG. 1 is a front view of an electric lid closure which embodies the present invention.

As is seen from FIGS. 1 and 2, the electric closing unit 20 comprises a support base 20*a* which is secured to the periphery 12 of the mouth portion 11 of the trunk room "TR" and a striker base 40 which is integrally formed with the above-mentioned striker 45.

Figure 3:
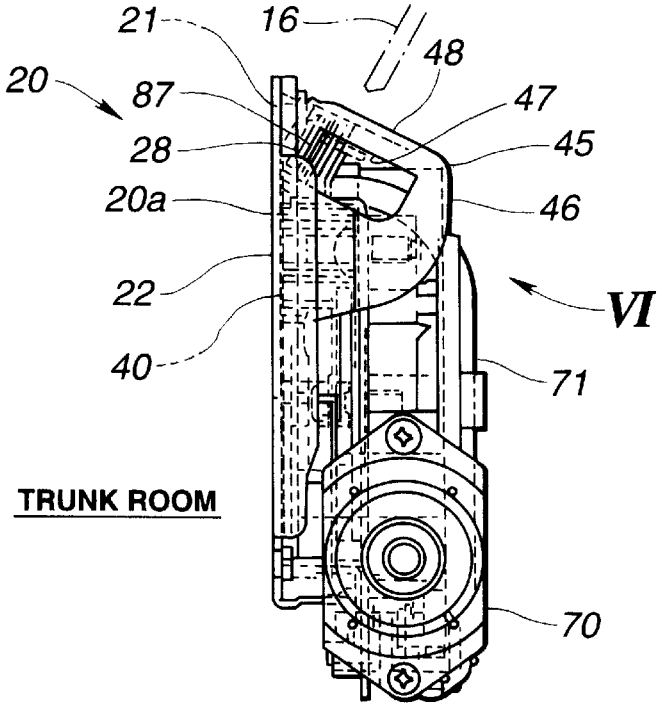
FIG. 3 is a side view of the electric lid closure of the invention.

As is seen from FIGS. 1 and 3, the support base 20*a* comprises a first vertical wall 22, a second vertical wall 24 and a step wall 23 through which the first and second vertical walls 22 and 24 are integrally connected. The step wall 23 is formed with a through opening 25.

Figure 8:
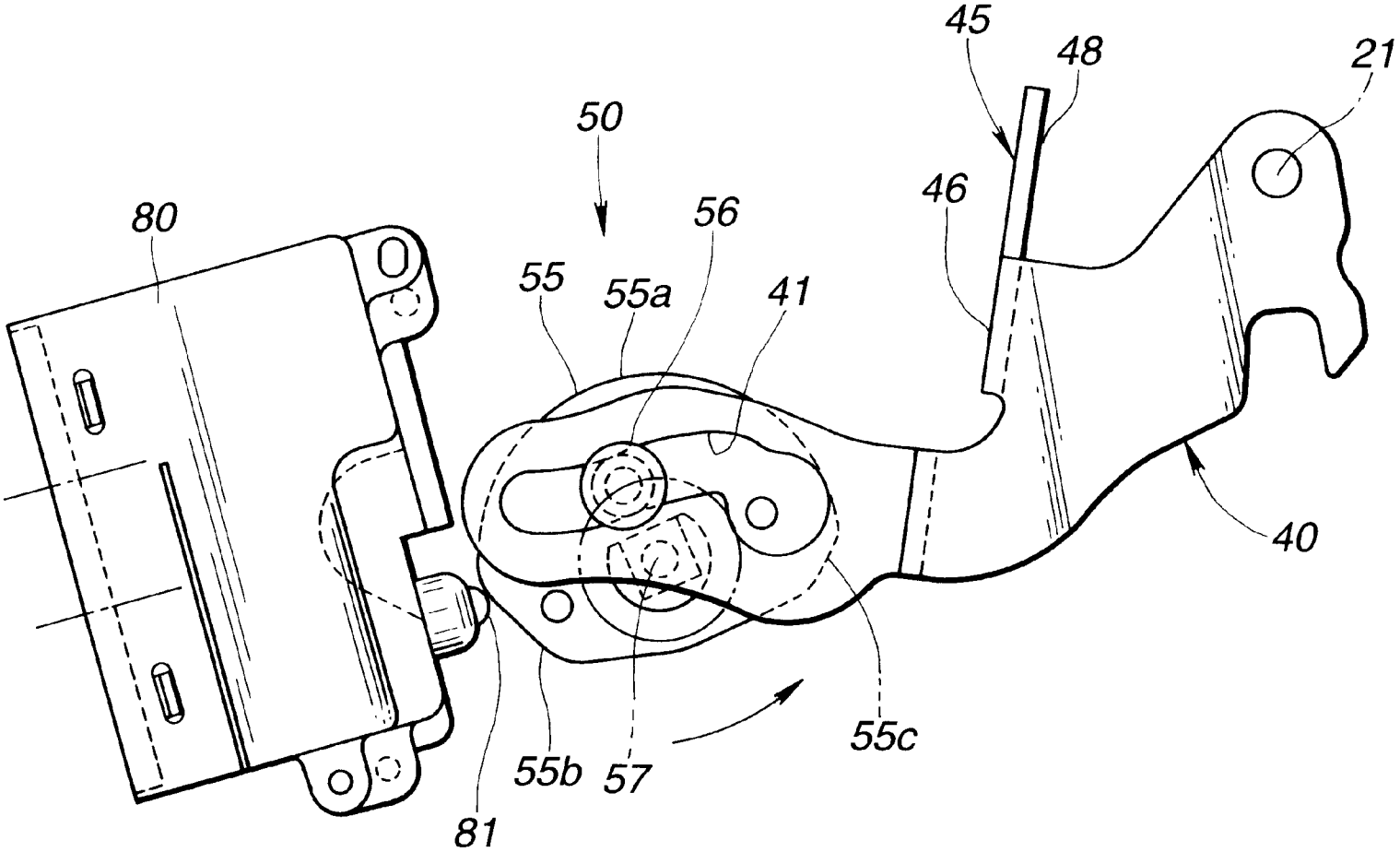
FIG. 8 is a drawing of the electric lid closure, showing one condition of the same.
Figure 9:
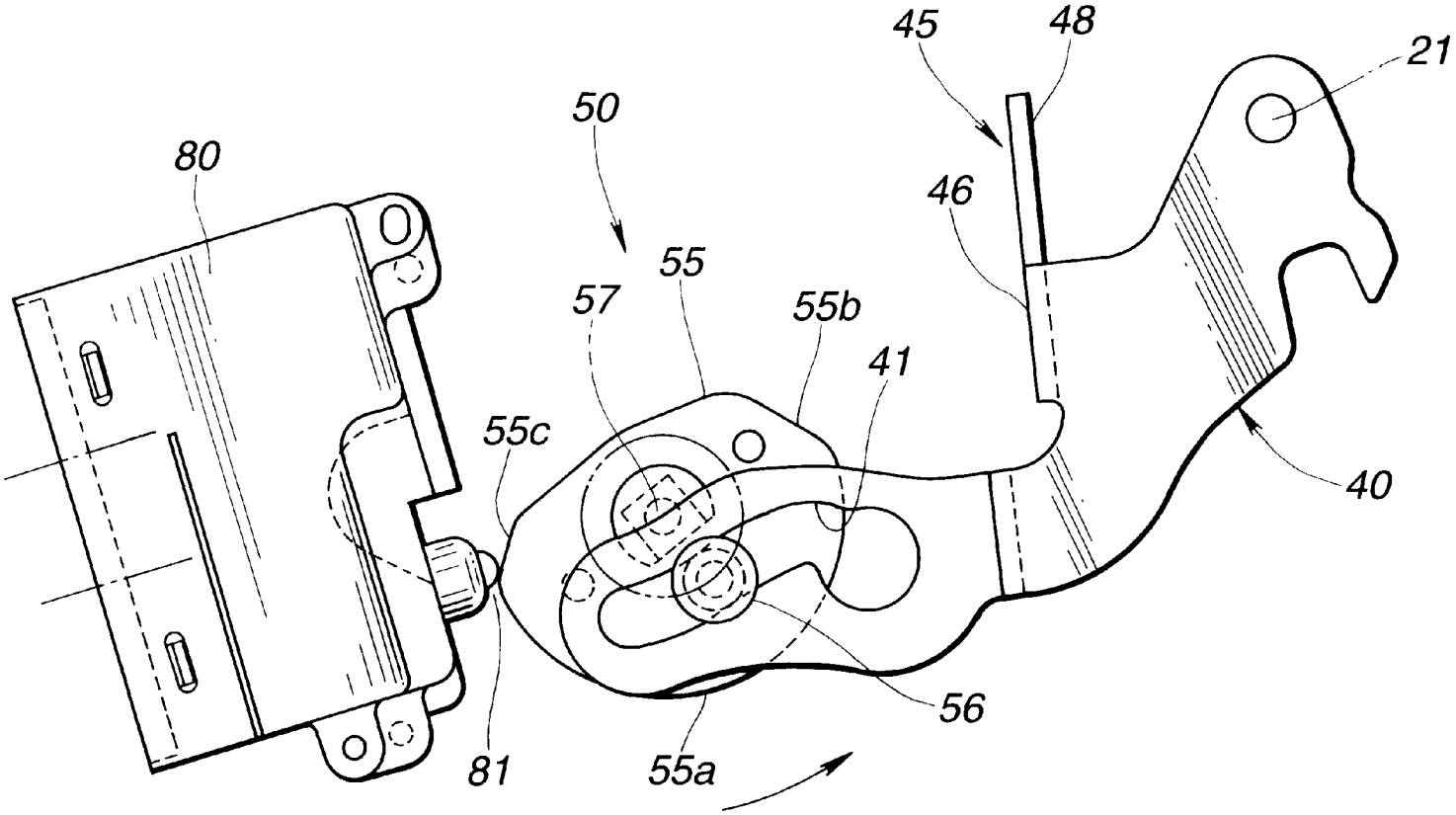
FIG. 9 is a drawing similar to FIG. 8, but showing another condition of the lid closure.

As is seen from FIG. 1, the support base 20*a* has at its right side a pivot pin 21 fixed thereto. A right end of the striker base 40 is pivotally connected to the pivot pin 21 so that the striker base 40 can pivot between an uppermost position as shown in FIG. 8 and a lowermost position as shown in FIG. 9. As will become apparent as the description proceeds, the uppermost position of the striker base 40 is referred to as a draw action starting position and the lowermost position of the same is referred to a draw action finishing position.

As is seen from FIGS. 1, 3 and 8, the striker 45 is provided at a middle portion of the striker base 40. The striker 45 comprises a bent portion 46 provided by bending a part of the striker base 40 and a striker bar 48 provided by forming an opening 47 in an upper part of the bent portion 46.

As will be seen from FIG. 3, the pivotal striker base 40 is slidably placed on the front surface of the first vertical wall 22 of the support base 20*a*.

Furthermore, as is seen from FIG. 3, a leading edge of the striker bar 48 is inclined relative to an imaginary plane over which the striker base 40 (and thus the striker bar 48) turns about the pivot pin 21.

When, as is seen from FIGS. 2 and 3, the trunk lid "TL" is about to take the full close position during its closing movement, the lock base 16 of the lock unit 15 fixed to the trunk lid "TL" approaches the striker bar 48 of the striker 45 obliquely from behind. During this, the striker bar 48 inserts into the striker inserting guide slot 16*a* of the lock base 16 of the lock unit 15.

As will become apparent hereinafter, during the time when the striker base 40 pivots between the draw action starting position and the draw action finishing position, the striker bar 48 of the striker 45 moves upward or downward in the striker inserting guide slot 16*a* of the lock base 16.

Figure 4A:
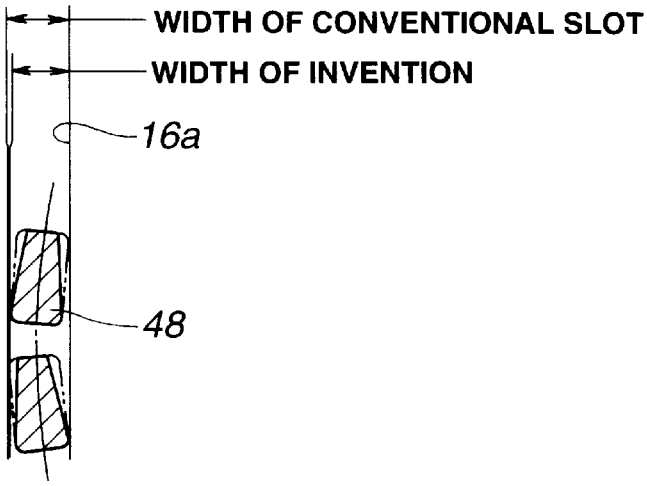
FIGS. 4A, 4B and 4C are illustrations of a striker, showing operation of the electric lid closure and illustrating the trapezoidal cross section of the striker bar.
Figure 4B:
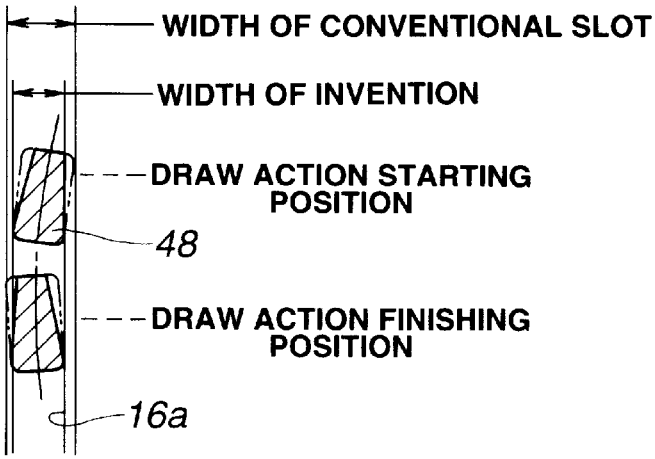
Figure 4C:
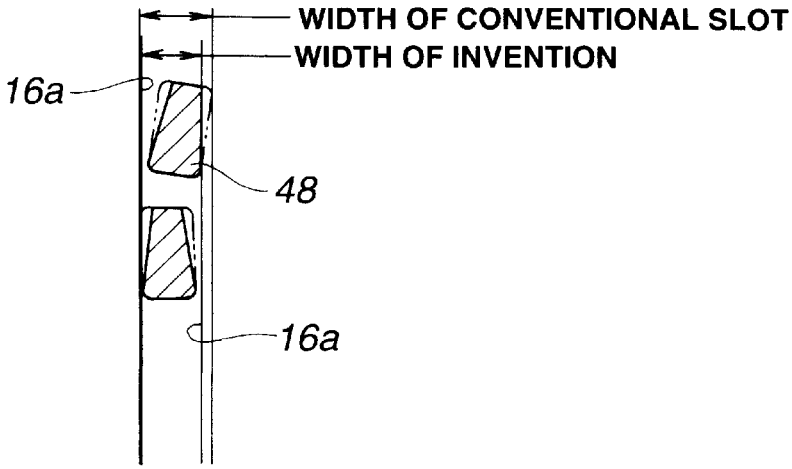

As is seen from FIGS. 4A to 4C, the striker bar 48 has a generally trapezoidal cross section with its leading edge made thinner than its trailing edge.

As is seen from FIG. 1, the support base 20*a* has on a left side thereof a drawing unit 50 mounted thereon. As will be described in detail hereinafter, the drawing unit 50 functions to draw the latch plate of the lock unit 15 downward through the striker 45. The striker base 40 passes through the through opening 25 of the support base 20*a* having a left portion thereof exposed to the rear side of the support base 20*a*. The left portion of the striker base 40 is formed with a cam slot 41.

The drawing unit 50 generally comprises the cam slot 41 of the striker base 40, a power arm 55 rotatably supported on the left portion of the support base 20*a*, a cam follower 56 pivotally connected to a peripheral portion of the power arm 55 and slidably engaged with the cam slot 41 and a power mechanism 70 for driving the power arm 55. The power mechanism 70 is mounted on the front surface of support base 20*a*.

As is seen from FIGS. 1 and 8, the power arm 55 has an input shaft 57 fixed to an eccentric part thereof. The input shaft 57 passes through an opening formed in the support base 20*a* and is operatively connected at its leading end to an output shaft of a speed reduction gear of the power mechanism 70. As is seen from FIG. 1, the power mechanism 70 comprises a housing 71 in which an electric motor and the speed reduction gear are installed. Thus, upon energization of the electric motor, the power of the motor is transmitted through the speed reduction gear to the power arm 55. Thus, the power arm 55 is rotated about an axis of the input shaft 57 to cause the cam follower 56 to move in the cam slot 41 while pivoting the striker base 40 upward or downward about the pivot pin 21 between the above-mentioned draw action starting and finishing positions.

As is seen from FIG. 1, to the left side of the support base 20*a*, there is mounted a draw condition detecting switch 80 which has a detecting follower 81 slidably engaged with a periphery of the power arm 55.

The power arm 55 comprises a semicircular part 55*a* which constitutes a half of the arm 55 and first and second depressed parts 55*b* and 55*c* which are located at circumferential ends of the semicircular part 55*a*. The outer periphery of the semicircular part 55*a* is concentric with the rotation center (viz., input shaft 57) of the power arm 55.

It is to be noted that the first depressed part 55*b* is used for detecting the above-mentioned draw action starting position, and the second depressed part 55*c* is used for detecting the draw action finishing position. That is, when the detecting follower 81 of the draw condition detecting switch 80 is in contact with either one of the first and second depressed parts 55*b* and 55*c*, the detecting switch 80 assumes ON state.

As is seen from FIG. 1, a lid position sensing lever 85 is pivotally connected to an upper part of the support base 20*a* through a pivot shaft 28. The sensing lever 85 has a generally L-shaped cross section to increase a mechanical strength thereof. The sensing lever 85 is formed with a detecting arm 86 and biased to pivot counterclockwise in FIG. 1 by means of a return spring 87 disposed about the pivot shaft 28. The detecting arm 86 is contactable with the lock base 16 of the lock unit 15 mounted to the trunk lid "TL".

A lid critical position sensing switch 88 is mounted to the support base 20*a* of the closing unit 20, which produces an electric signal representing a critical position of the trunk lid "TL" based on the movement of the position sensing lever 85.

Figure 6B:
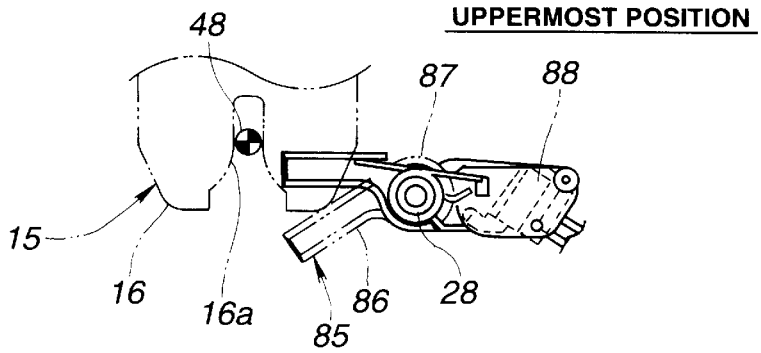
Figure 6C:
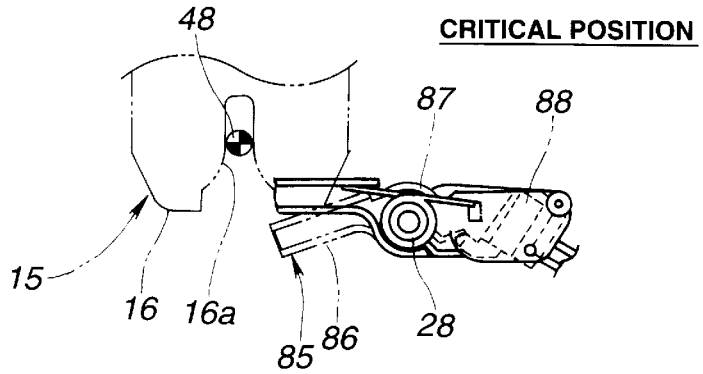

FIGS. 6A, 6B and 6C show a positional relationship between the lid position sensing lever 85 and the lock base 16 with respect to the locked condition between the striker bar 48 of the striker 45 and the latch plate of the lock unit 15. For showing the detail of the construction of the lid position sensing lever 85, these drawings are those viewed from a back side of FIG. 1.

FIG. 6A shows, by a phantom line, a position assumed by the sensing lever 85 when the striker bar 48 fully engages with the latch plate of the lock unit 15 with the striker base 40 taking the lowermost position of FIG. 9. As shown, in this case, the detecting arm 86 is turned largely by the lock base 16 against the force of the spring 87. It is to be noted that the position of the sensing lever 85 shown by a solid line is a rest position assumed by the lever 85 when the trunk lid "TL" is fully open. That is, when having no load, the sensing lever 85 assumes a generally horizontal position.

FIG. 6B shows, by a phantom line, a position assumed by the sensing lever 85 when the striker bar 48 fully engages with the latch plate of the lock unit 15 with the striker base 40 taking the uppermost position of FIG. 8. As shown, in this case, the detecting arm 86 is turned small by the lock base 16 against the force of the spring 87.

FIG. 6C shows, by a phantom line, a position assumed by the sensing lever 85 when the striker bar 48 fully engages with the latch plate of the lock unit 15 with the striker base 40 taking a position corresponding to the critical position of the trunk lid "TL", which is slightly higher than the uppermost position of FIG. 8. As shown, in this case, the detecting arm 86 is turned slightly by the lock base 16 against the force of the spring 87.

As will be described in detail hereinafter, when the trunk lid "TL" is pushed down to such critical position after establishing the latched engagement between the striker bar 48 and the latch plate, the drawing unit 50 becomes energized to start drawing the trunk lid "TL" downward.

Figure 5:
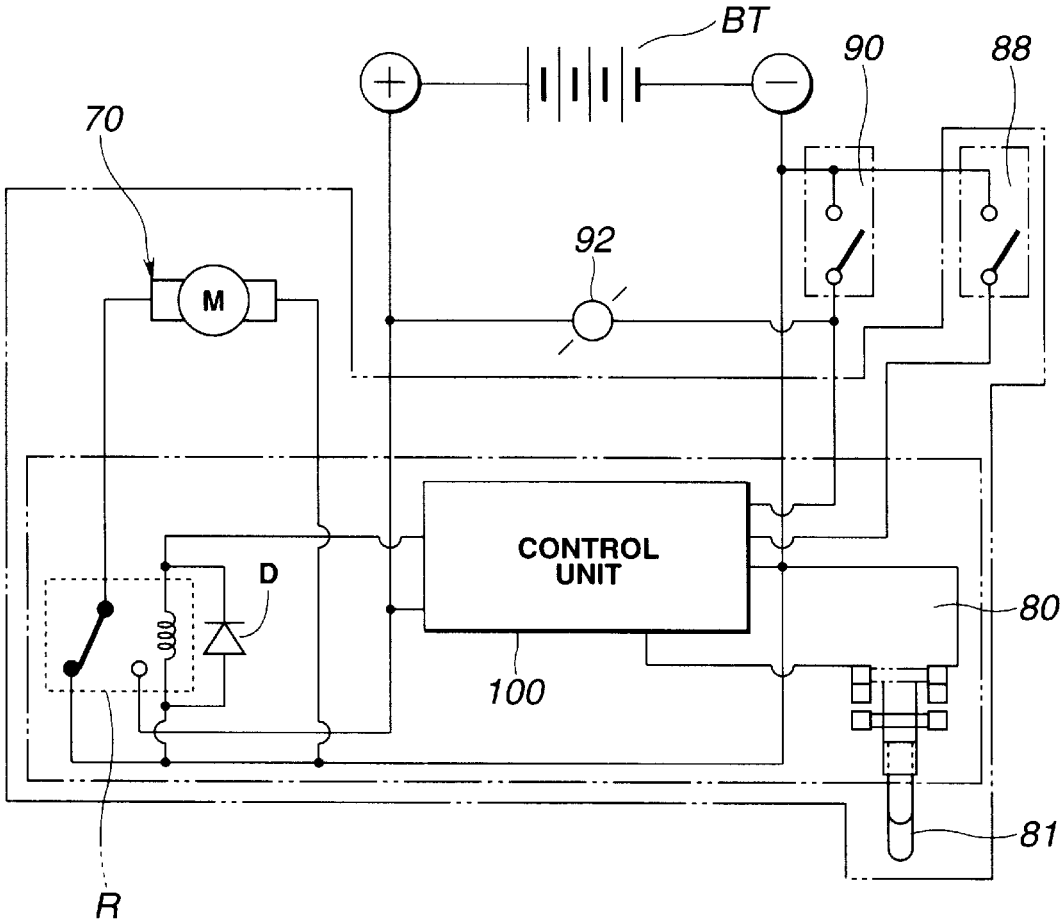
FIG. 5 is a control circuit for controlling the electric lid closure.
Figure 7:
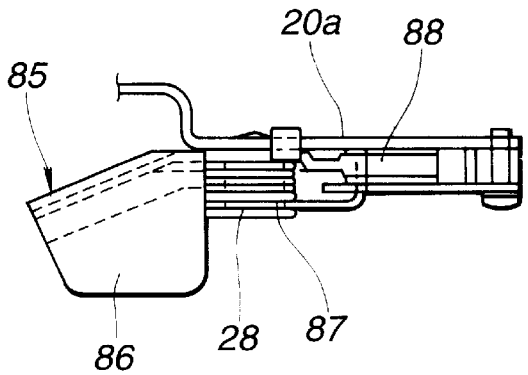
FIG. 7 is a view taken from the direction of the arrow "VII" of FIG. 6A.

FIG. 5 shows a control circuit for controlling the power mechanism 70 of the drawing unit 50. As shown, one terminal of the lid critical position sensing switch 88 is connected to a negative terminal of a battery "BT". The other terminal of the switch 88 is led to a control unit 100. A lock switch 90 has one terminal connected to the negative terminal of the battery "BT" and the other terminal led to the control unit 100. A lock lamp 92 has one terminal connected to a positive terminal of the battery "BT" and the other terminal connected to the other terminal of the lock switch 90. It is to be noted that the lock switch 90 assumes its ON state to energize the lock lamp 92 when the latch plate of the lock unit 15 is properly engaged with the striker 45 and locked by the locking plate. The draw condition detecting switch 80 has terminals connected to the control unit 100, one of which is connected to the negative terminal of the battery "BT". The electric motor "M" of the power mechanism 70 has one terminal connected to the negative terminal of the battery "BT" and the other terminal led to a switching section of a relay "R" which has one terminal connected to the negative terminal of the battery "BT" and the other terminal led to the control unit 100. An energizing section of the relay "R" has one terminal connected to the control unit 100 and the other terminal connected to the negative terminal of the battery "BT". A diode "D" is possessed by the energizing section.

The control unit 100 is programmed to carry out the following operation. That is, energization of the motor "M" of the power mechanism 70 is effected only when all of the lock switch 90, the draw condition detecting switch 80 and the lid critical position sensing switch 88 assume their ON state. In other words, even when the latch plate of the lock unit 15 fully engages with the striker 45 and the draw condition detecting switch 80 detects the draw action starting position, energization of the motor is not achieved if the trunk lid "TL" fails to pass by the critical position. That is, only when the lid critical position sensing switch 88 senses passing of the trunk lid "TL" by the critical position that is somewhat higher than the position assumed by the trunk lid "TL" when the striker base 40 assumes the uppermost position of FIG. 8, the motor can be energized.

In the following, operation will be described.

For ease of understanding, description will be commenced with respect to a full open condition of the trunk lid "TL".

Under this condition, the lock unit 15 assumes a release condition inducing OFF state of the lock switch 90, and the striker base 40 of the electric closing unit 20 assumes the draw action starting position (viz., uppermost position) of FIG. 8. Thus, the detecting follower 81 of the draw condition detecting switch 80 is in contact with the first depressed part 55*b* of the power arm 55 inducing ON state of the switch 80. Furthermore, under this open condition of the trunk lid "TL", the detecting arm 86 of the sensing lever 85 assumes the rest position shown by the solid line in for example FIG. 6B, inducing OFF state of the lid critical position sensing switch 88.

When, due to application of a certain force to the trunk lid "TL", the lid "TL" starts to be pivoted downward, that is, in a closing direction, the lock unit 15 approaches obliquely the striker 45 provided by the draw unit 50. During this approaching, the striker bar 48 of the striker 45 enters the striker inserting guide slot 16*a* of the lock base 16 (see FIG. 6C) and finally engages with the latch plate of the lock unit 15. It is now to be noted that any shock then applied to the striker bar 48 from the latch plate of the lock unit 15 is wholly received by the first vertical wall 22 of the support base 20*a* which slidably supports a base part of the bent portion 46 and its neighboring part. Since the striker bar 48 of the striker 45 and the first vertical wall 22 of the support base 20*a* are positioned close to each other, any moment produced around the base part of the bent potion 46 upon receiving the shock is small, which enables the striker 45, the striker base 40 and the first vertical wall 22 to have a satisfied durability.

When the striker bar 48 of the striker 45 is brought into engagement with the latch plate of the lock unit 15 as is described hereinabove, the locking plate of the lock unit 15 is pivoted to the lock position to lock the latch plate at the latch position. Upon this, the lock switch 90 is turned ON.

When, due to further downward pivoting of the trunk lid "TL", the lock base 16 of the lock unit 15 becomes into abutment with and pushes down the detecting arm 86 of the lid position sensing lever 85 beyond the above-mentioned critical position of FIG. 6C, the lid critical position sensing switch 88 is turned ON.

Upon this, the control unit 100 starts the drawing unit 50 and thus rotates the electric motor "M" of the power mechanism 70 in a lid drawing direction. With this, the power arm 55 (see FIG. 8) is rotated in a counterclockwise direction in FIG. 8 about the axis of the input shaft 57 to start operation of the drawing unit 50.

That is, when the power arm 55 is rotated in the counterclockwise direction in FIG. 8, the cam follower 56 of the power arm 55 turns in the same direction while moving in the cam slot 41 of the striker base 40 pushing down the striker base 40 about the pivot pin 21. Thus, during this, the trunk lid "TL" is gradually pulled down.

During this downward movement of the trunk lid "TL", the striker 45 is slidably guided at one edge by the first vertical wall 22 of the support base 20*a*. That is, even when the striker bar 48 receives a force from the latch plate of the lock unit 15 from the oblique direction (see FIG. 3), a subsequent downward movement of the striker base 40 is carried out vertically, which can minimize the degree by which the electric closing unit 20 projects into the trunk room "TR". That is, provision of the unit 20 does not affect the capacity of the trunk room "TR".

As will be seen from FIG. 8, during the counterclockwise rotation of the power arm 55 inducing the downward pivoting of the striker base 40 about the pivot 21, the detecting follower 81 slides on the outer edge of the semicircular part 55*a* of the power arm 55.

When, thus, the striker base 40 is brought to the lowermost position (viz., the draw action finishing position) of FIG. 9, the detecting follower 81 comes to the second depressed part 55*c* of the power arm 55. With this, the draw condition detecting switch 80 is turned OFF stopping energization of the electric motor "M". Upon stopping energization of the motor "M", the control unit 100 returns the lid critical position sensing switch 88 to OFF state.

The trunk lid "TL" is thus fully lowered and assumes a full close condition. At a final period of the lid closing movement, a periphery of the trunk lid "TL" contacts and presses the weather strip "WS" on the periphery 12 (see FIG. 2) of the trunk room mouth portion 11. Thus, in the full close condition of the trunk lid "TL", a water-tight sealing is achieved between the lid "TL" and the trunk room "TR".

Under the full close condition of the trunk lid "TL", the detecting arm 86 of the lid position sensing lever 85 assumes the largely pivoted position (as illustrated by a phantom line) of FIG. 6A.

It is now to be noted that as is seen from FIG. 4B, during the downward pivoting of the trunk lid "TL" powered by the electric motor "M", the striker bar 48 of the striker 45 moves down along a curved path, while the striker inserting guide slot 16*a* of the lock base 16 moves down along a substantially straight path. More specifically, the positional interrelation between the striker bar 48 and the guide slot 16*a* is so made that the traveling path of the guide slot 16*a* projects a straight image on an imaginary plane over which the striker bar 48 turns about the pivot pin 21.

FIGS. 4A to 4C are provided for explaining an advantage given by the unique structure of the striker bar 48 of the striker 45. FIGS. 4A and 4C show positions of the striker bar 48 at the draw action starting and finishing positions of the striker base 40, which would be assumed when the striker base 40 is inaccurately assembled with its left side displaced down and up from a normal or right position shown by FIG. 4B.

As is shown by these drawings and has been mentioned hereinafore, the striker bar 48 has a generally trapezoidal cross section with its leading edge made thinner than its trailing edge. Due to this trapezoidal cross section possessed by the striker bar 48, the striker inserting guide slot 16*a* of the lock base 16 can be made small in width as will be understood from the drawings. That is, if the striker bar 48 has a rectangular cross section as is illustrated by a phantom line, the striker inserting guide slot 16*a* is compelled to have a larger width for accommodating such striker bar. Furthermore, even if the striker base 40 is assembled inaccurately in such a manner as is shown in FIGS. 4A and 4C, the striker bar 48 having the trapezoidal cross section can be inserted in the guide slot 16*a* without interfering with edges of the guide slot 16*a*.

When now, for opening the trunk lid "TL", a trunk open lever (not shown) installed in the vehicle cabin is manipulated, the locking plate of the lock unit 15 unlocks the latch plate to cause the latter to release the striker bar 48 inducing OFF state of the lock switch 90. Under this condition, the trunk lid "TL" is readily opened when a certain force is applied to the lid "TL" in an opening direction. Upon release of the striker bar 48 from the latch plate, the restoring force of the weather strip "WS" lifts the trunk lid "TL" slightly thereby permitting the detecting arm 86 of is the lid position sensing lever 85 to pivot upward passing by the critical position of FIG. 6C. Thus, the lid critical position sensing switch 88 is turned ON. Upon receiving the ON signal from the switch 88, the control unit 100 energizes the electric motor "M" of the power mechanism 70 to run in a reversed direction, and thus the power arm 55 (see FIG. 9) is rotated in a clockwise direction in this drawing pivoting up the striker base 40 about the pivot pin 21. When the turning of the power arm 55 comes to the position where the detecting follower 81 contacts the first depressed part 55*c* of the power arm 55 inducing ON state of the draw condition detecting switch 80, the control unit 100 stops energization of the electric motor "M". Thus, upon this, the striker base 40 assumes the uppermost position (viz., the draw action starting position) of FIG. 8.

When, under this condition, the trunk lid "TL" is applied with a certain force in a lid opening direction, the lid "TL" is pivoted upward. Thus, the lock base 16 of the lock unit 15 is moved up separating from the striker bar 48. During this, the detecting arm 86 of the lid position sensing lever 85 is pivoted upward to the horizontal position due to the force of return spring 87.

Thus, in the full open condition of the trunk lid "TL", as has been mentioned hereinabove, the lock unit 15 assumes the release condition inducing OFF state of the lock switch 90, the striker base 40 of the electric closing unit 20 assumes the draw action starting position (viz., uppermost position) of FIG. 8 inducing ON state of the draw condition detecting switch 80 and the detecting arm 86 of the lid position sensing lever 85 assumes the horizontal position inducing OFF state of the lid critical position sensing switch 88.

As is described hereinabove, in the full close condition of the trunk lid "TL", the draw condition detecting switch 80 is OFF, the lid critical position sensing switch 88 is OFF and the lock switch 90 is ON.

When the trunk open lever is manipulated for the purpose of opening the trunk lid "TL", the locking plate of the lock unit 15 unlocks the latch plate causing the latter to release the striker bar 48 inducing OFF state of the lock switch 90. If now, in winter, due to a freezing between periphery of the trunk lid "TL" and the weather strip "WS" on the mouth of the trunk room "TR", such release of the striker bar 48 from the latch plate fails to have the trunk lid "TL" sufficiently open, the lock base 16 of the lock unit 15 fails to be sufficiently lifted. In this case, the detecting arm 86 of the lid position sensing lever 85 fails to pass by the critical position of FIG. 6C and thus the lid critical position sensing switch 88 is kept OFF. Thus, even when the trunk lid "TL" is accidentally or carelessly pushed down to a position to bring about the engagement between the latch plate and the striker bar 48 inducing ON state of the lock switch 90, the drawing unit 50 does not operate. That is, the trunk lid "TL" is prevented from taking an unexpected full close locked position.

In the following, advantages of the present invention will be described.

First, as is described hereinabove, during a downward movement of the trunk lid "TL", the striker 45 is slidably guided at one edge by the first vertical wall 22 of the support base 20*a*. That is, even when the striker bar 48 receives a force from the latch plate of the lock unit 15 from an oblique direction (see FIG. 3), a subsequent downward movement of the striker base 40 powered by the electric motor "M" is made in a vertical direction, which can minimize the degree by which the electric closing unit 20 of the electric lid closure "ELC" of the invention projects into the trunk room "TR". Thus, the trunk room "TR" can be effectively used. This means that the electric closing unit 20 is applicable to various types of trunk lid closures only changing the striker base 40.

Second, due to the trapezoidal cross section possessed by the striker bar 48, the striker inserting guide slot 16*a* of the lock base 16 can be made small in width. This enables the lock base 16 to be compact in size and thus the lock unit 15 can be made compact in size and light in weight.

Third, any shock applied to the striker bar 48 from the latch plate of the lock unit 15 upon engagement therebetween is wholly received by the first vertical wall 22 of the support base 20*a* and its neighboring parts. Since the striker bar 48 and the first vertical wall 22 of the support base 20*a* are positioned close to each other, any moment produced around the base part of the striker 45 is small. Thus, the striker 45, the striker base 40 and the first vertical wall 22 can have a satisfactory durability.

In the foregoing description, the description is made with respect to an arrangement wherein the lock unit 15 is fixed to the trunk lid "TL" and the electric closing unit 20 is fixed to the mouth portion of the trunk room "TR". However, if desired, the lock unit 15 and the electric closing unit 20 may be fixed to the trunk room "TR" and the trunk lid "TL" respectively.

The entire contents of Japanese Patent Applications 10-208301 (filed Jul. 23, 1998) and 10-208302 (filed Jul. 23, 1998) are incorporated herein by reference.

Although the invention has been described above by reference certain embodiments of the invention, the invention is not limited to the embodiments described above. Modifications and variations of the embodiments described above will occur to those skilled in the art, in light of the above teachings.

What is claimed is:

1. An electric lid closure for use with an automotive trunk lid which pivots to close a trunk room of the vehicle, said electric lid closure comprising:

a lock unit adapted to be mounted to said trunk lid, said lock unit including a latch plate; and an electric closing unit adapted to be mounted to a mouth portion of said trunk room, said electric closing unit including a support base, a striker base pivotally connected through a pivot pin to said support base, a striker fixed with said striker base and engageable with said latch plate, and an electric power mechanism for pivoting said striker base between uppermost and lowermost positions by an electric power, the striker having a leading edge for contacting engagement with the latch plate and wherein the leading edge of said striker is inclined relative to an imaginary plane over which said striker base turns about said pivot pin.

2. An electric lid closure as claimed in claim 1, in which said striker is provided with a striker bar whose front edge constitutes said leading edge.

3. An electric lid closure as claimed in claim 2, in which said striker base is slidably placed on said support base.

4. An electric lid closure as claimed in claim 3, in which said support base comprises a first flat wall, and a second flat wall and a step wall through which said first and second flat walls are connected, said step wall being formed with an opening through which a major portion of said striker base movably passes.

5. An electric lid closure as claimed in claim 4, in which said electric power mechanism comprises:

an electric motor;

a speed reduction gear powered by said electric motor;

a power arm rotated by an output shaft of said speed reduction gear;

a cam follower connected to said power arm; and a cam slot formed in a free end portion of said striker base and having said cam follower slidably engaged therewith.

6. An electric lid closure as claimed in claim 2, in which said lock unit further comprises a lock base which is formed with a striker inserting guide slot for receiving said striker bar and in which said striker bar has a generally trapezoidal cross section with a leading edge thereof made thinner than a trailing edge thereof.

7. An electric lid closure as claimed in claim 1, further comprising:

a first position sensor which senses whether said striker base assumes said uppermost position or said lowermost position;

a second position sensor which senses whether said trunk lid passes by a critical position or not, said critical position corresponding to a position of said striker base which is above said uppermost position;

a third position sensor which senses whether said locking plate locks said latch plate or not; and a control unit which energizes said electric closing unit to pull down said trunk lid to a full close position only when said first position sensor senses said striker assuming the uppermost position, said second position sensor senses said trunk lid passing by said critical position and said third position sensor senses said latch plate being locked by said locking plate.

8. An electric lid closure for use with an automotive trunk lid which pivots to close a trunk room of the vehicle, said electric lid closure comprising:

a lock unit adapted to be mounted to said trunk lid, said lock unit including a latch plate and a lock base, said lock base being formed with a striker inserting guide slot; and an electric closing unit adapted to be mounted to a mouth portion of said trunk room, said electric closing unit including a support base, a striker base pivotally connected through a pivot pin to said support base, a striker bar defined by said striker base and capable of inserting into said striker inserting guide slot for contacting engagement with said latch plate, wherein said striker bar has a generally trapezoidal cross section with a leading edge thereof made thinner than a trailing edge thereof.

9. An electric lid closure as claimed in claim 8, in which said electric closing unit further comprises an electric power mechanism which pivots said striker base about said pivot pin between uppermost and lowermost positions by an electric power and in which said lock unit further comprises a locking plate which is able to lock said latch plate.

* * * * *